US005839675A

United States Patent [19]

Henreckson et al.

[11] Patent Number: 5,839,675

[45] Date of Patent: Nov. 24, 1998

[54] SHREDDER SUPPORT ASSEMBLY AND HOUSING

[75] Inventors: Todd Henreckson, Gurnee; Tim Bohn, Hoffman Estates; Mark Dziersk, Chigago, all of Ill.

[73] Assignee: General Binding Corporation, Northbrook, Ill.

[21] Appl. No.: 720,579

[22] Filed: Oct. 2, 1996

[51] Int. Cl.[6] ..... B02C 18/16

[52] U.S. Cl. ..... 241/100; 241/236; 241/285.2

[58] Field of Search ..... 241/100, 236, 241/285.2, 301; D18/34; 248/685, 213.2

[56] References Cited

U.S. PATENT DOCUMENTS

| | | | |
|---|---|---|---|
| D. 298,435 | 11/1988 | Buteau . | |
| D. 375,973 | 11/1996 | Kennedy et al. | D18/34 |
| 920,747 | 5/1909 | Hughes | 248/213.2 |
| 1,857,617 | 5/1932 | Berdon | 248/213.2 X |
| 2,101,700 | 12/1937 | Chestnut | 241/100 X |
| 3,724,766 | 4/1973 | Bosland | 241/100 |
| 4,489,897 | 12/1984 | Turner et al. | 241/236 X |
| 4,637,560 | 1/1987 | Goldhammer | 241/100 |
| 4,846,076 | 7/1989 | Menges et al. | 248/213.2 X |
| 4,973,004 | 11/1990 | Krause et al. | 241/100 |
| 4,997,134 | 3/1991 | MacGregor . | |
| 5,211,294 | 5/1993 | Garman | 248/213.2 X |

*Primary Examiner*—John M. Husar
*Attorney, Agent, or Firm*—Hill, Steadman & Simpson

[57] ABSTRACT

A housing including a support arm arrangement for a basket mounted paper shredder wherein the support arms have curved or rounded outside perimeters and at least one of the support arms has a curved or rounded inside support rib arrangement to more closely conform to a rounded waste paper basket. The support arm arrangement allows the paper shredder to be mounted to both round and rectangular waste paper baskets. The housing also provides a streamlined shape including a tapered generally triangular motor wiring compartment.

18 Claims, 4 Drawing Sheets

SHREDDER SUPPORT ASSEMBLY AND HOUSING

BACKGROUND OF THE INVENTION

The present invention relates to a document shredding device, particularly to document shredding devices which are placed over a bin such as a waste receptacle so that shredded pieces of the document fall into the waste receptacle. Such document shredders are described in U.S. Pat. Nos. 3,724,766; 4,973,004; and D375,973.

The mechanisms for shredding documents such as sheets of paper fed into the shredder, can be derived from the above cited utility patents, and also from U.S. Pat. No. 4,489,897.

Some small personal shredders are sold without shredder baskets and must rely on waste paper baskets normally found in the office or in the home. These waste paper baskets come in all shapes and sizes. In European countries the waste paper baskets are typically round while in the United States many waste papers baskets are square or rectangular in shape.

U.S. Pat. No. 3,724,766 discloses a shredder having oppositely arranged retaining and supporting portions which can be adjusted in length to accommodate different size waste paper baskets. The portions have generally square cut, straight channels for receiving edges of the waste paper basket. U.S. Pat. No. 4,973,004 describes a paper shredder for support onto a waste receptacle which includes a clamping device to grip one edge of the waste receptacle. A generally rectangular cut groove is provided for this purpose. The above cited. U.S. Design Pat. No. D375,973 also describes in its figures a generally straight channel for receiving edges of a waste receptacle.

SUMMARY OF THE INVENTION

It is an object of the present invention to provide an extendable support arm for a bin or waste receptacle supported paper shredder which is compatible to engage both round opening waste receptacles and rectangular opening waste receptacles securely and precisely. It is an object of the invention to provide an arm structure for a paper shredder which is shaped to conform to a round opening waste receptacle so as not to extend unduly therefrom. It is an object of the invention to provide a paper shredder support arrangement which conforms closely to a round opening waste receptacle.

It is an object of the invention to provide a streamline shape for a housing of a paper shredder which minimizes obstruction of a top opening of a bin or basket supporting the shredder.

An object of the invention is achieved in a paper shredder having a first engaging portion at one end thereof and a second engaging portion arranged to be adjustably distanced from the first engaging portion wherein at least one of engaging portions, and preferably both retaining portions, are arranged having an arcuate perimeter. The two engaging portions can be provided with at least one arcuate inside retaining surfaces, such as provided by stiffening gussets, for abutment to the side wall of a round opening waste receptacles. One of the engaging portions can have stiffening gussets forming a straight retaining surface for abutment to a sidewall of a rectangular opening receptacle.

The present invention is designed to fit on a variety of waste paper baskets. The adjustable arm of the shredder shown in the figures can be extended or retracted to fit different size baskets, both square/rectangular and round shaped-opening baskets. With the adjustable arm fully retracted, the shredder defines the smallest basket opening it will accept. With the adjustable arm fully extended the shredder defines the largest basket opening it will accept.

An object is also achieved in that a streamlined housing is provided having an elongate, generally rectangular compartment for housing shredding rollers and a triangular compartment for housing the shredder motor and wiring, eliminating the rectangular motor compartments of the prior art and providing increased space adjacent the shredder to deposit waste materials directly into the basket.

DETAILED DESCRIPTION OF THE PREFERRED EMBODIMENTS

Figure 1:
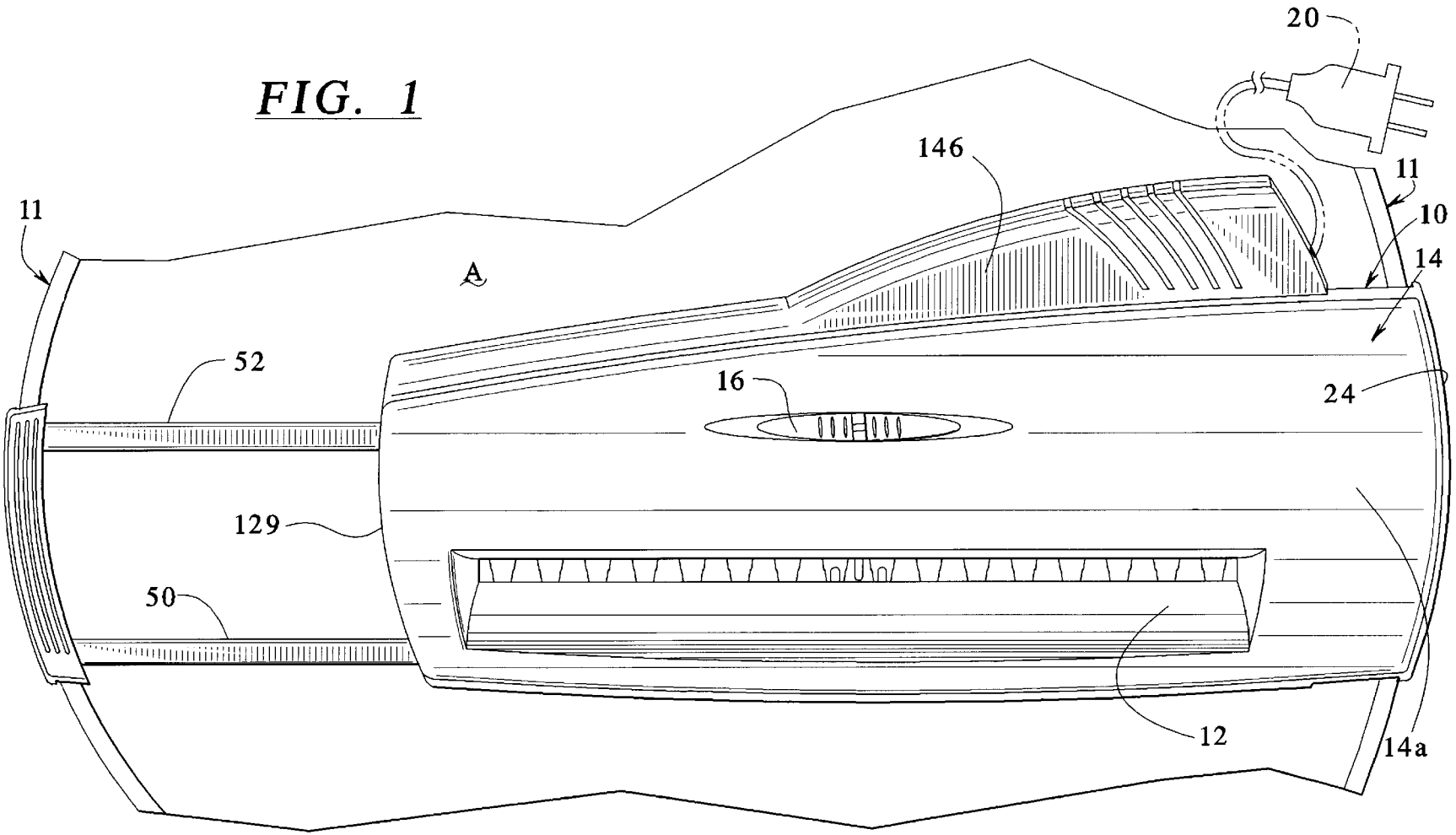
FIG. 1 is a plan view of paper shredder supported on a receptacle according to the present invention.

FIG. 1 illustrates a paper shredder 10 supported on a receptacle 11 having a guided inlet slot 12 for receiving paper to be shredded into a housing 14 which contains the shredding mechanism. The mechanism can be of known design such as disclosed in U.S. Pat. Nos. 3,724,766 or 4,489,897, or other known shredding mechanisms. An activation switch 16 is moved laterally to start the shredding procedure and also includes automatic, forward and reverse positions. An electrical utility plug 20 connects power to the shredder 10. The shredder 10 provides a curved first end 24 and a curved second end 26 which allow the shredder 10 to substantially conform to a circular waste receptacle which supports the shredder 10.

Figure 2:
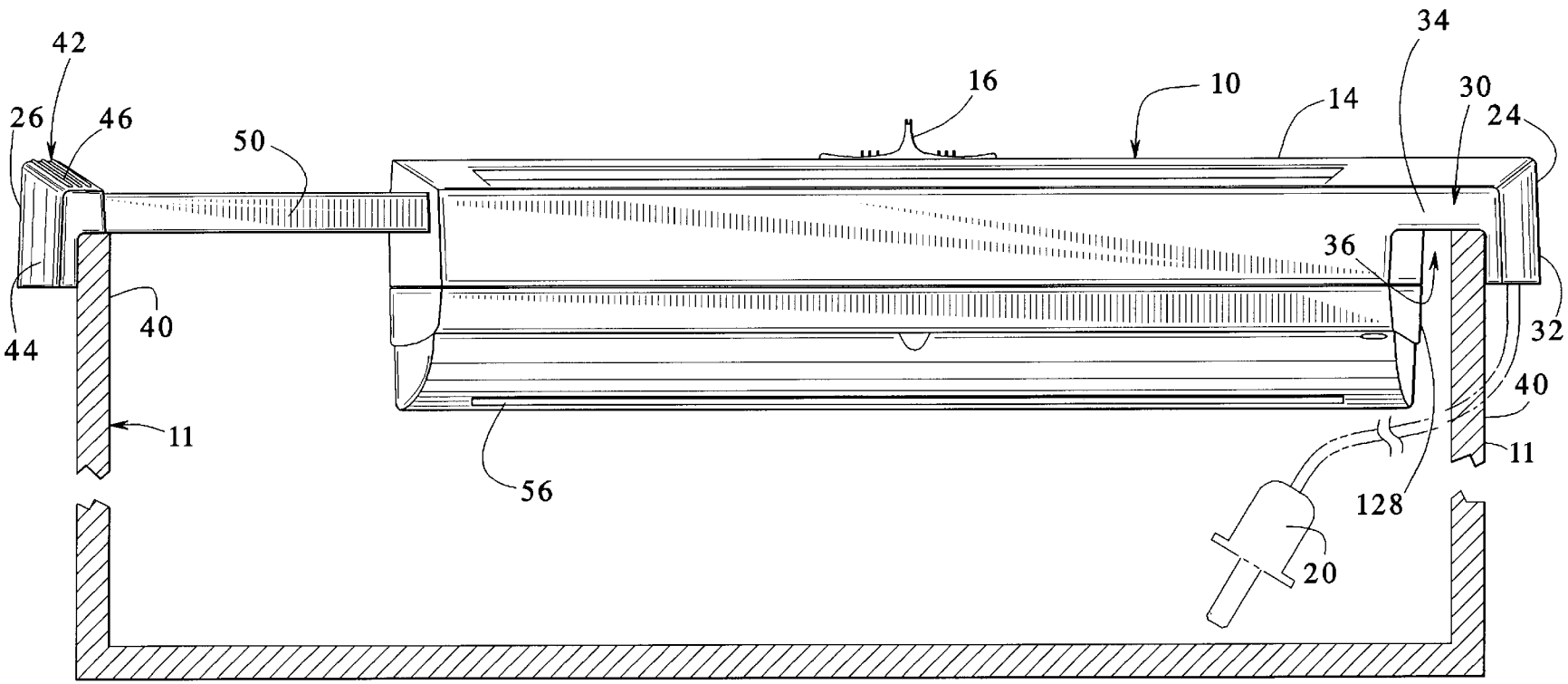
FIG. 2 is an elevational view of the paper shredder shown in FIG. 1.

FIG. 2 illustrates the elevational view of the shredder 10 supported on the waste receptacle 11. At the first end 24 is located a first L-shaped support portion 30 having a down turned leg 32 and a horizontal leg 34, forming a channel 36 for receiving a sidewall 40 of the receptacle 11. The opposite end 26 includes a second L-shaped portion having a down turned leg 44 and a horizontal leg 46 for receiving and being supported on the sidewall 40 of the receptacle 11. The second L-shaped portion 42 is connected by two slide rails 50, 52 which extend from and retract into the housing 14. Thus, the shredder 10 can be adapted to fit different sized receptacles. The body 14 includes an outlet slot 56 wherein shredded paper is deposited into the receptacle 11.

Figure 3:
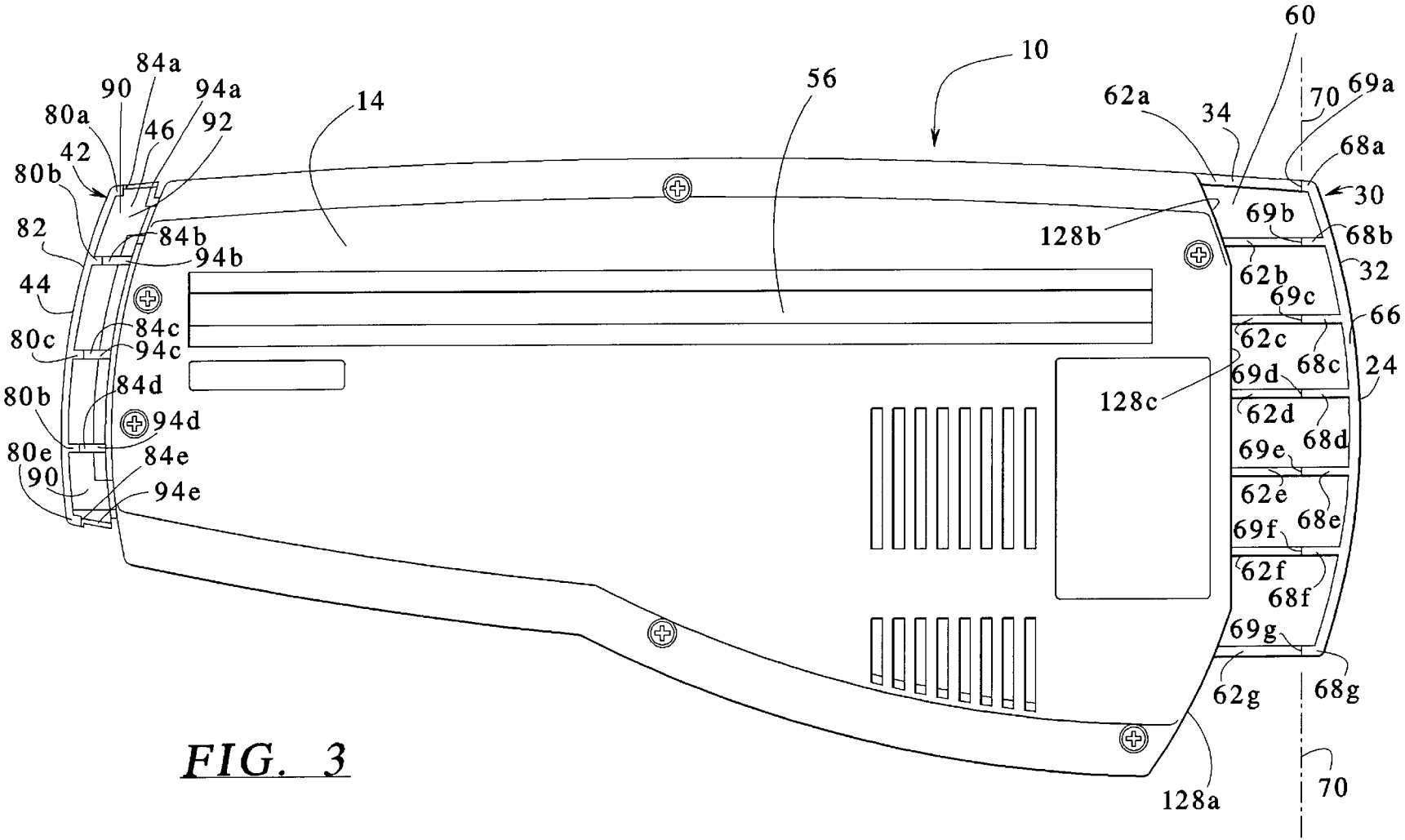
FIG. 3 is a bottom view of the paper shredder shown in FIG. 1 with an extendable arm retracted.

FIG. 3 illustrates a bottom view of the shredder 10 which shows the first L-shaped portion 30 having the vertical portion 32 and the horizontal portion 34. The horizontal portion 34 includes a flat top plate 60 supported below by a plurality of perpendicularly extending, parallel ribs 62*a–g*. The vertical portion 32 includes a vertically arranged and curved sidewall 66 having inwardly directed and upstanding ribs 68*a–g* which connect to, such as by being molded integrally with, the ribs 62*a–g*, respectively, and which have upstanding edges 69*a–g* which align along a straight line 70.

The second L-shape portion 42 with the vertical portion 44 and the horizontal portion 46 is shown retracted in FIG. 3. The vertical portion 44 includes ribs 80*a–e* upstanding and connected to a curved outside wall 82. The ribs 80*a–e* have edges 84*a–e* which extend from the wall 82 toward the body 14 along an arcuate, in this case circular, path 90.

The horizontal portion 46 includes a top plate 92 and vertically disposed supporting ribs 94*a–e* connected to, such as by being molded integrally with, the ribs 80*a–e,* respectively.

In accordance with the invention, a circular waste receptacle will be guided substantially by the ribs 80*a–e* about its circumference C, by at least two ribs having edges along the arcuate path 90—90 while at an opposite side the waste receptacle will be guided by one or two ribs aligned along the straight line 70—70. For a rectangular receptacle, the one side of the receptacle would fit flat against the ribs 68*a–*68*g* along the line 70—70 and be engaged by at least one rib along the arcuate path 90—90, and most likely two ribs. Alternatively, the edges 69*a–*69*g* can also be fashioned around an arcuate, in particular circular, path such that both engaging portions 30, 42 are designed to conform to a circular receptacle, but which also are wide enough to receive a rectangular receptacle.

Figure 4:
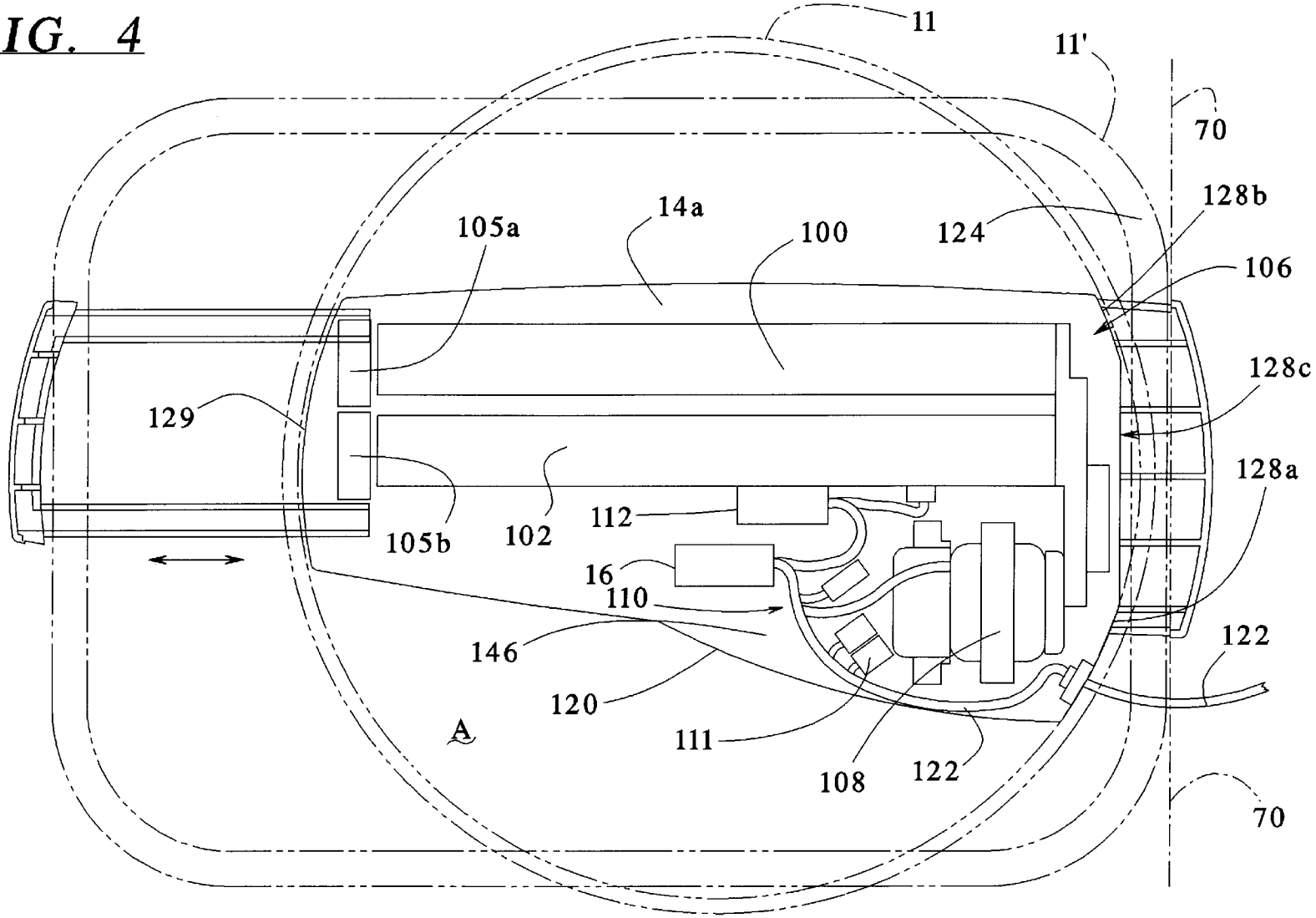
FIG. 4 is a bottom view of the paper shredder shown in FIG. 1 with the bottom cover removed.

FIG. 4 illustrates a bottom view of the shredder of FIG. 1 with a bottom cover removed. The components inside the housing 14 are shown only schematically. The shredder 10 includes shredding rollers 100, 102 having intermeshed cutters (not shown) such as described in U.S. Pat. Nos. 4,489,897 or 3,724,766. The rollers are geared together by gearing 105*a,* 105*b*. The rollers are driven by gear train 106 driven by a motor 108. The motor 108 is connected by wires 110 and connectors 111 to the switch and to a relay 112.

As part of the invention the housing 14 is advantageously streamlined to provide a maximum clear area A of the open top of the waste receptacle to allow depositing of trash without necessarily feeding through the shredder 10. To achieve this object, the housing 14 includes a generally rectangular compartment 14*a* and a triangular compartment 14*b* having a tapered wall 120 which precisely conforms to the space needed to accommodate the motor and wiring associated with the motor, switch and relay without allocating excess volume. This includes space provided for the power cord 122 connected to the plug 20.

FIG. 4 also shows in phantom how the present shredder can be used to accept either a round opening receptacle 11 or a rectangular receptacle 11' having a flange 124 around its opening. The clearance between the line 70—70, described in FIG. 3, and an outside wall 128 of the housing is sufficient for receiving this flange 124. Alternatively a round opening receptacle 11 can fit against the wall 128 and an opposite wall 129 of the shredder, both walls 128, 129 being substantially arcuately, in this case circularly shaped. The wall 128 has circular regions 128*a,* 128*b* and flat region 128*c*.

Although the present invention has been described with reference to a specific embodiment, those of skill in the art will recognize that changes may be made thereto without departing from the scope and spirit of the invention as set forth in the appended claims.

We claim:

1. A support arm arrangement for a paper shredder mountable to waste paper baskets comprising:

a first support portion extending from one side of the paper shredder; and a second support portion extending from an opposite side of said paper shredder, said first and second support portions having first and second vertically arranged guides, respectively, which are arrangeable on outside surfaces of said waste paper baskets, at least one of said vertically arranged guides defining an arcuately shaped recess capable of selectively receiving a linear edge of one waste paper basket and a non-linear edge of another waste paper basket, and having an arcuate surface arranged for abutting the outside surfaces of the waste paper baskets.

2. The support arm arrangement according to claim 1, wherein said arcuate surface is formed by a plurality of spaced apart ribs.

3. The support arm arrangement according to claim 1, wherein both said first and second vertically arranged guides define an arcuately shaped recess capable of selectively receiving the linear edge of one waste paper basket and the non-linear edge of another waste paper basket, and have an arcuate surface arranged for abutting the outside surfaces of the waste paper baskets.

4. The support arm arrangement according to claim 1, wherein a respective other of said first and second vertically arranged guides comprises a linear support surface arranged for abutting the outside surfaces of the waste paper baskets.

5. The support arm arrangement according to claim 4, wherein said linear support surface is formed by a plurality of spaced apart ribs.

6. The support arm arrangement according to claim 1, wherein at least one of said first and second support portions is retractable toward and away from the respective other of said first and second support portions.

7. The support arm arrangement according to claim 1, wherein both said support portions comprise outer arcuate perimeters.

8. The support arm arrangement according to claim 7, wherein a respective other of said vertically arranged guides comprises a linear support surface arranged for abutting the outside surfaces of the waste paper baskets.

9. A paper shredder housing for containing a paper shredding mechanism which includes a motor for driving parallel shredding rollers having cutters thereon, comprising:

an elongate generally rectangular compartment providing an enclosed area sized for holding parallel shredding rollers; and a generally triangular compartment contiguous to said generally rectangular compartment sized for holding a motor for driving shredding rollers.

10. The housing according to claim 9 further comprising a first support portion connected to said rectangular housing and having a first horizontal support surface and first vertical guide extending downwardly from said first horizontal support surface;

a second support portion connected to said rectangular housing and having a second horizontal support surface and a second vertical guide extending downwardly from said second horizontal support surface; and said first and second vertical guides having rounded outside perimeters.

11. The housing according to claim 10 wherein one of said first and second vertical guides comprises an arcuate guide surface facing inwardly toward said rectangular compartment.

12. The housing according to claim 11 wherein a respective other of said first and second vertical guides comprises a linear guide surface facing inwardly toward said rectangular compartment.

13. The housing according to claim 12 wherein one of said first and second support portions is moveable toward and away from said rectangular compartment.

14. A paper shredder removably and alternatively mountable on a first receptacle having an arcuate edge and a second receptacle having a linear edge, the paper shredder comprising:

a shredder housing containing a paper shredding member; and first and second supports extending outward from the housing each of the first and second supports having opposed walls defining a recess, the opposed walls being spaced apart a predetermined distance such that the recess is capable of alternatively receiving the arcuate edge of the first receptacle and the linear edge of the second receptacle;

wherein at least one of the opposed walls in both the first and second supports has an arcuate shape.

15. The paper shredder of claim 14 wherein the arcuate shaped wall is defined by a plurality of space apart ribs.

16. The paper shredder of claim 14 wherein one of the opposed walls in at least one of the first and second supports has a linear shape.

17. The paper shredder of claim 16 wherein the linear shaped wall is defined by a plurality of space apart ribs.

18. The paper shredder of claim 14 wherein at least one of the first and second supports is movable such that a distance between the recesses in the first and second supports is variable.

* * * * *